US007670180B2

(12) United States Patent
Gerard et al.

(10) Patent No.: US 7,670,180 B2
(45) **Date of Patent: *Mar. 2, 2010**

(54) SHIELDED SUBMINIATURE CONNECTION ASSEMBLY AND PROCESS OF FORMING SUCH AN ASSEMBLY

(75) Inventors: Philippe Gerard, Chennevieres-sur-Marne (FR); Philippe Mallet, Paris (FR)

(73) Assignee: Souriau, Versailles (FR)

( * ) Notice: Subject to any disclaimer, the term of this patent is extended or adjusted under 35 U.S.C. 154(b) by 0 days.

This patent is subject to a terminal disclaimer.

(21) Appl. No.: 12/138,535

(22) Filed: Jun. 13, 2008

(65) Prior Publication Data

US 2009/0004896 A1 Jan. 1, 2009

(30) Foreign Application Priority Data

Jun. 15, 2007 (FR) ..... 07 04271
Jun. 15, 2007 (FR) ..... 07 04273

(51) Int. Cl.
*H01R 13/648* (2006.01)

(52) U.S. Cl. ..... 439/607.01; 439/465

(58) Field of Classification Search ..... 439/95, 439/465, 610, 296

See application file for complete search history.

(56) References Cited

U.S. PATENT DOCUMENTS 4,600,480 A 7/1986 Coombes et al.
4,662,700 A * 5/1987 Markham ..... 439/607
4,715,827 A 12/1987 Furman
4,749,369 A 6/1988 Wang
4,822,304 A * 4/1989 Herron ..... 439/610
4,838,808 A * 6/1989 Fujiura ..... 439/357
4,992,060 A * 2/1991 Meyer ..... 439/620.21
5,046,967 A 9/1991 Majernik
6,354,879 B1 * 3/2002 Plehaty ..... 439/610
2005/0054226 A1 3/2005 Akama et al.

FOREIGN PATENT DOCUMENTS

EP 0090539 A2 10/1983
EP 0421373 A1 4/1991
EP 0434431 A1 6/1991
EP 0684665 A2 11/1995
EP 0694990 A1 1/1996
EP 0736931 A1 10/1996
EP 1150391 A1 10/2001

OTHER PUBLICATIONS

Search Report dated Jan. 30, 2008 for 07/04273 and 07/04271.

* cited by examiner

*Primary Examiner*—Edwin A. Leon
*Assistant Examiner*—Vanessa Girardi
(74) *Attorney, Agent, or Firm*—Perman & Green LLP

(57) ABSTRACT

A shielded subminiature connection assembly having two subminiature connectors with housings provided with means of locking, two molded thermoplastic half-shells having a high contact density miniature sub-assembly with a molded thermoplastic insulating body provided with contact cavities for the positioning and retention of contacts, a back plate provided with a contact-retaining clip and whose sidewalls comprise projecting members, a molded thermoplastic receptacle shell including a flange provided with oblong apertures into which the projecting members of the back plate are locked. The disclosed embodiments also concern the process of forming the connection assembly.

10 Claims, 4 Drawing Sheets

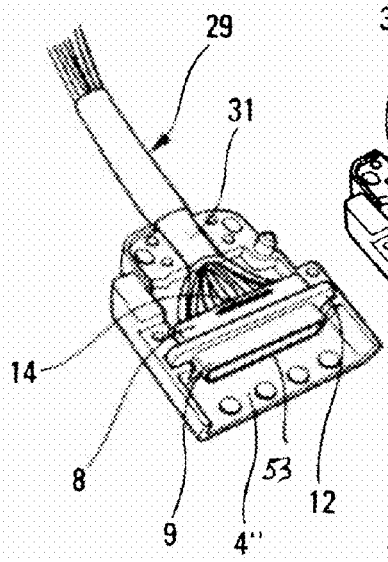
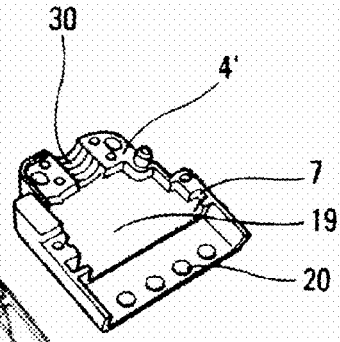
Fig. 6
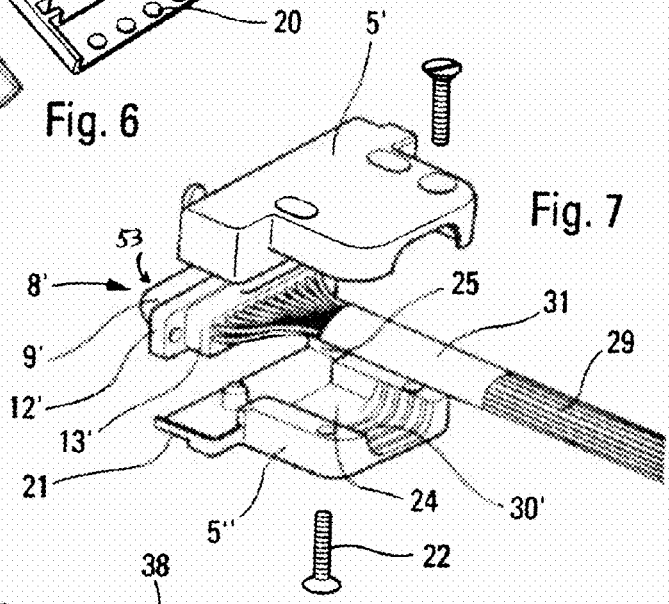
Fig. 7
Fig. 8a
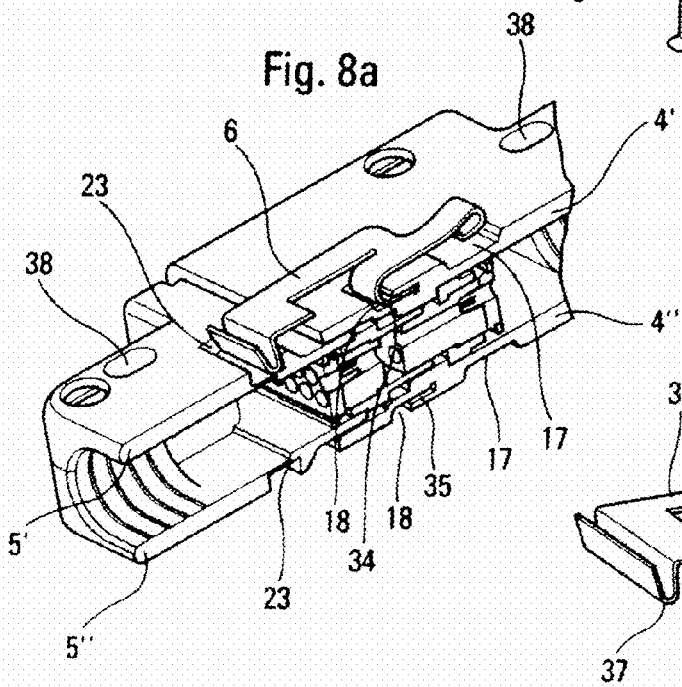
Fig. 8b
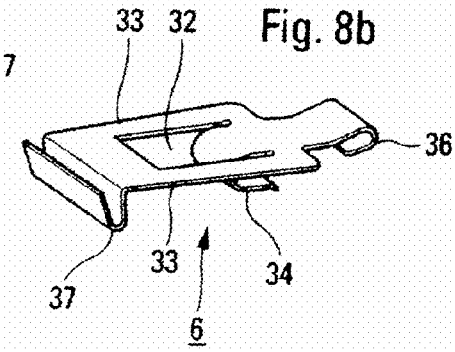

SHIELDED SUBMINIATURE CONNECTION ASSEMBLY AND PROCESS OF FORMING SUCH AN ASSEMBLY

CROSS REFERENCE TO RELATED APPLICATIONS

This application claims priority to French Patent Application Serial Nos. 0704271 and 0704273, both filed Jun. 15, 2007, the disclosures of which are incorporated herein by reference in their entireties.

BACKGROUND

1. Field

The aspects of the disclosed embodiments provide a shielded sub-miniature connection assembly and more particularly a connection assembly consisting of two sub-miniature connectors equipped with high contact density movable modules.

The aspects of the disclosed embodiments also provide a process for producing a sub-miniature shielded connection assembly consisting of two sub-miniature connectors and more particularly the process of wiring of the components of the connection assembly.

The aspects of the disclosed embodiments can be applied in areas such as cable connectors, in the field of data processing, of audio-visual communications, of telecommunications and more generally, in fields calling for the processing of multiple signals in a network.

2. Brief Description of Related Development

In the field of shielded sub-miniature connectors, the utilization is known of an insulating body provided with contact cavities, making possible the positioning and retention of electrical contacts lodged in a shielded housing. The said shielded housing generally consists of two metal half-shells provided with means making it possible for them to be assembled round the insulating body and the strand of wires, which extends the contacts inserted in the insulation. The assembly and the positioning of the components are not easy and when the half-shells have been assembled, it is usual to carry out duplicate thermoplastic molding (insert molding) which filters into the interior of the shielded housing during the operation, making impossible any subsequent disassembly operations.

Likewise known is the use of thermoplastic housings obtained in the presses used for the duplicate thermoplastic molding operations of contacts and their associated wires, or the insulating body equipped with its contacts and associated wires. As a result of using this technique, any disassembly, repair or post-commissioning operations are rendered impossible.

Housings of this type are generally provided with an insulating component comprising contact cavities, into which are inserted the electrical contacts crimped to their stripped wire ends and forming a cable.

The classical assembly of this type of connector comprises a phase of preparation of the wire and cable ends, their positioning in the insulating body and a phase of duplicate molding of the insulating body/housing assembly.

In the case of a connector without a shielded housing, it is the insulating assembly/cable, which is duplicate molded.

In both cases, any operations of disassembly for the replacement of contacts, wires, or the cable, in manufacture in order to effect repairs, or after commissioning, are impossible.

With the development of audio-visual and data-processing techniques, for example those made available to passengers in large civil aviation aircraft, it becomes essential to secure major advantages in terms of space, weight and maintenance of all equipment needed to make the said techniques available.

There is accordingly a need to provide equipment, which will offset the drawbacks of products of the prior art and which will meet the requirement of extreme miniaturization, easy assembly and an ability to be disassembled for the purposes of replacement of defective components, or of improvement in performance.

There is likewise a need to provide equipment which will offset the drawbacks of products of the prior art and which will make possible the rapid incorporation of components able to modify the configuration of networks and the maintenance of equipment.

SUMMARY

With this in view, the aspects of the disclosed embodiments are directed to a shielded sub-miniature connection assembly consisting of two sub-miniature connectors comprising housings consisting of two molded thermoplastic half-shells and provided with means of locking and in which each sub-miniature connector comprises a high contact density miniature sub-assembly.

According to one embodiment, the sub-assembly is movable.

According to an embodiment, the thermoplastic of the two half-shells is covered with nickel protection.

According to another embodiment, the housing comprises a positioning site whose section is suitable for receiving a sub-assembly.

According to an embodiment, the sub-assembly comprises a molded thermoplastic insulating body provided with contact cavities for the positioning and retention of contacts, a back plate provided with a contact-retaining clip 52, whose sidewalls comprise projecting members 51, a molded thermoplastic receptacle shell comprising a flange with oblong apertures into which the back plate projecting members 51 are locked.

According to this embodiment, the contact-retaining clip 52 makes possible the passage through its center of the insulator of electric wires equipped with crimped contacts 53, constituting a strand, which comprises a shielded ferrule.

According to this embodiment, the receptacle shell inserts itself into the site of the half-shell, the strand positions itself in the space whose back open end constitutes a wire passage receiving the strand shield ferrule to provide the continuity of ground of the shield of the strand and of the half-shells.

The aspects of the disclosed embodiments are also directed to a process of creating a shielded sub-miniature connection assembly consisting of two sub-miniature connectors comprising housings consisting of two molded thermoplastic half-shells and high contact density miniature sub-assemblies in the following stages, namely

- surface treatment by passing the housing half-shells through a nickel bath;
- a stage of wiring of a sub-assembly;
- the introduction of the wired movable sub-assembly into a positioning site;
- the closing of the housing by fixing the half-shells by means of screws and catches.

According to an embodiment, the stage of wiring of a sub-assembly comprises the following stages, namely a first cable comprising a spacing cross-pin is stripped along a length, thus exposing a length of flexible braid of the cable shield;

each wire comprising the cable is stripped and a contact made from an electrically conducting material is crimped onto the end of the wire;

each contact equipped with its wire is inserted into the bore made in a clip of the back plate of the sub-assembly and positioned in a cavity of the insulating body contiguous to three other contact-receiving contact cavities of a same cable;

a second cable is prepared in the same way and the contacts are positioned;

a third cable is prepared in the same way and the contacts are positioned;

the ground contacts are crimped onto the flexible braid and positioned whilst the wires transmitting the weak signals are equipped with contacts crimped and positioned in free line sites;

the parts of stripped flexible braids of cables are grouped and connected by a metal sheet;

the earth and free line wires are arranged round the sheet and the strand thus formed is covered by a metal sheet, which constitutes a shield ferrule.

According to an embodiment, the ferrule provides continuity of ground between the strand and the shielded housings of the subminiature connectors and provides the continuous shield of an assembly of subminiature connections forming the link of the cable connectors.

The aspects of the disclosed embodiments will be better understood with the help of the description, which follows and the appended drawings where:

Figure 4A:
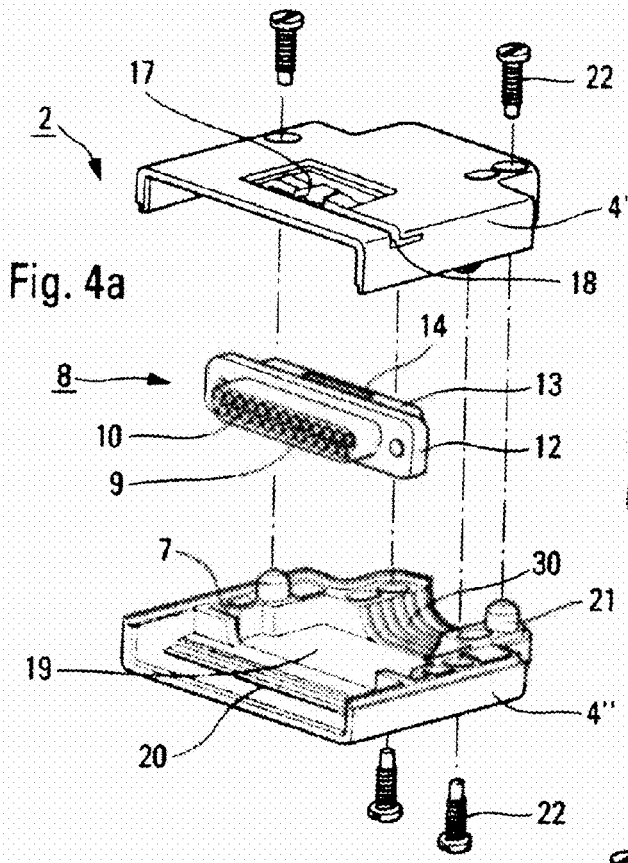
Figure 4B:
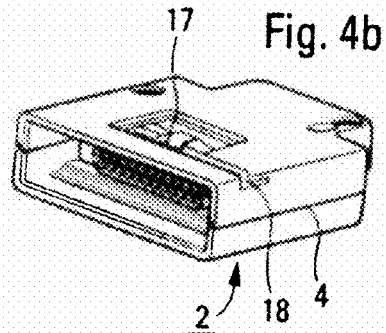
Figure 5B:
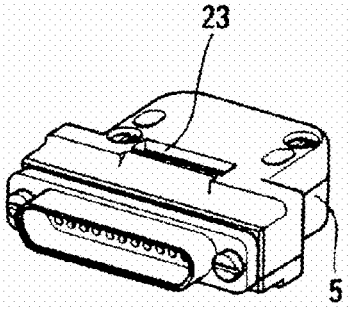
Figure 5A:
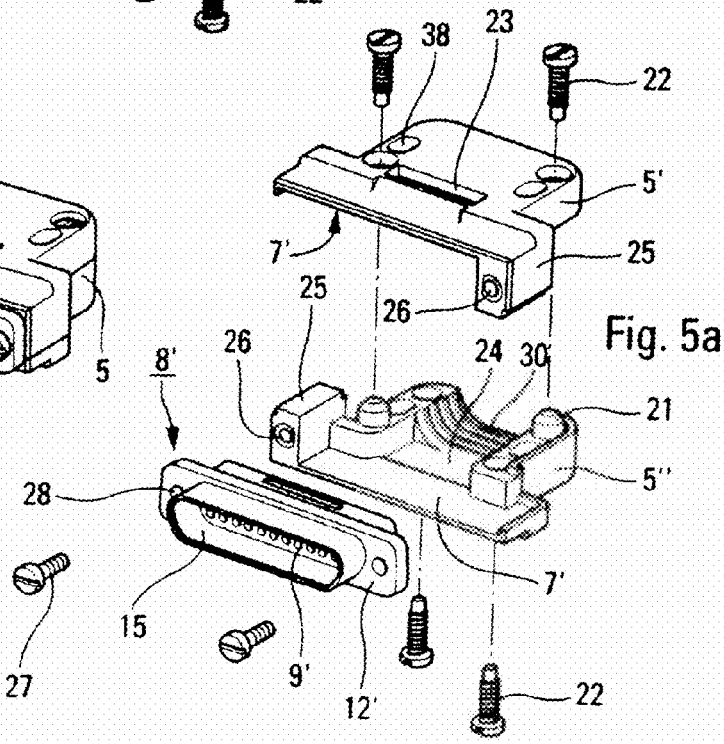
Figure 9:
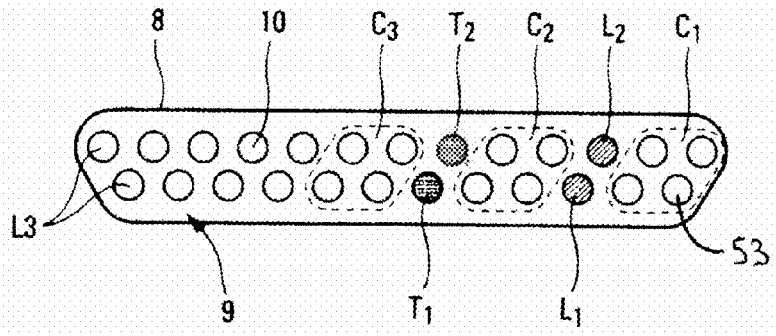
Figure 10A:
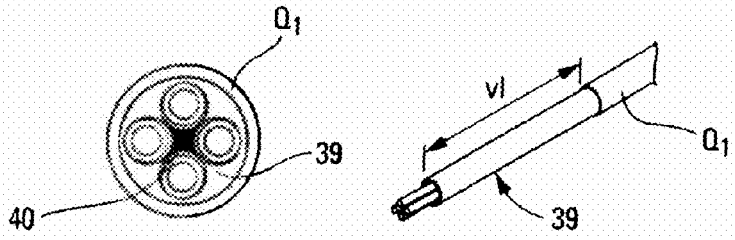
Figure 10B:
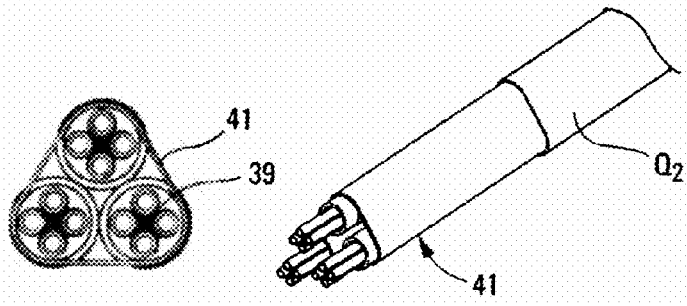
Figure 10C:
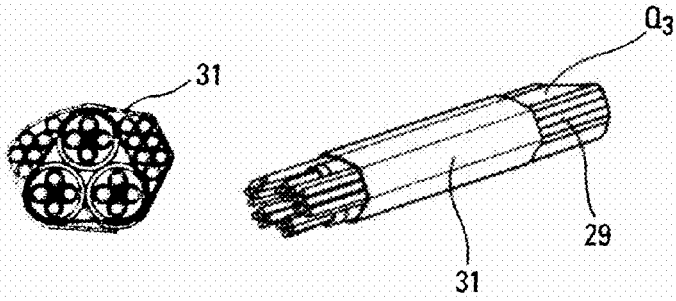

FIGS. 4*a*, 4*b* show a first connector of the connection assembly;

FIGS. 5*a*, 5*b* show a second complementary connector of the connection assembly;

FIG. 6 represents a plan view of a cable connector in the process of manufacture;

FIG. 7 shows the stage of assembly of the complementary connector;

FIGS. 8*a*, 8*b* show an embodiment of an assembly latch;

FIG. 9 shows the introduction of a connector equipped with an Ethernet network type cable;

FIGS. 10*a*, 10*b*, 10*c* show the stages of wiring of a connector according to the disclosed embodiments.

DESCRIPTION OF THE DISCLOSED EMBODIMENTS

Figure 1:
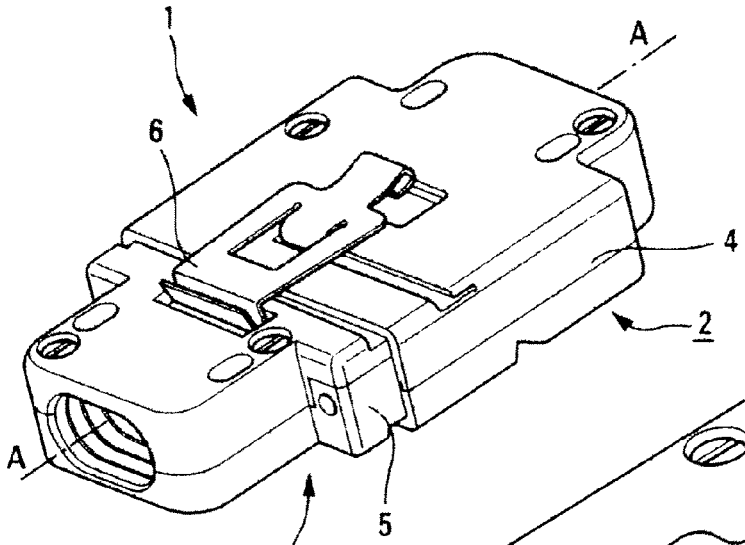
FIG. 1 shows in perspective view a connection assembly 1 according to the present invention.

FIG. 1 shows a shielded sub-miniature connection assembly 1 consisting of two sub-miniature connectors 2, 3 comprising housings 4 and 5, consisting of two molded thermoplastic half-shells 4'-4" and 5'-5" coated with nickel protection and provided with complementary means of coupling such as a locking mechanism of the type of latch 6 and such as the means of guidance to make possible the assembly of the connector 2 and its complementary mating connector 3. The connectors 2 and 3 are likewise equipped with means of retaining contacts. These contacts, which are not shown, may be electrical copper or conducting alloy contacts, optical contacts, or an arrangement comprising different types of terminal.

Figure 2:
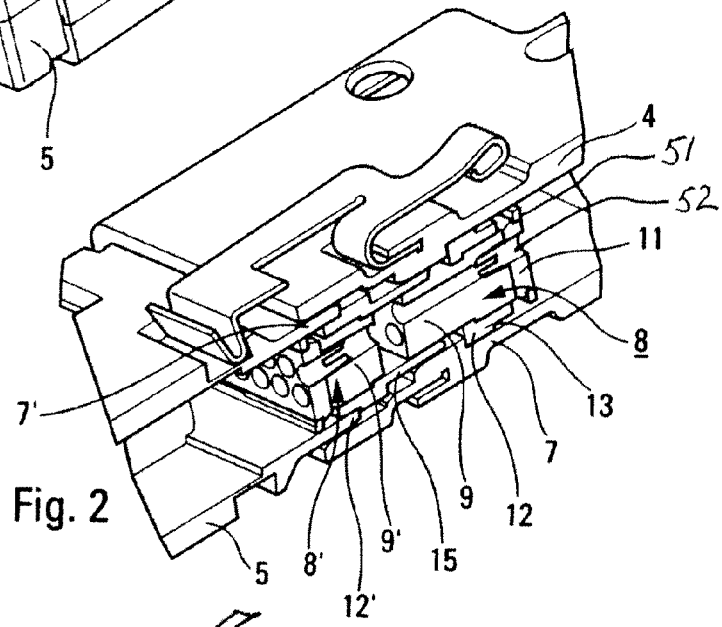
FIG. 2 is a partial section of FIG. 1 along line AA.

The contact-retaining and guidance means, making possible the coupling of the connectors, are shown in FIG. 2, which is a partial perspective section along line AA of FIG. 1.

On the one hand, the housing 4 of the connector 2 comprises a groove 7, whose section is suited to the reception of a sub-assembly or movable module 8, consisting of a high contact density subminiature connector, whose front face is formed by a molded thermoplastic insulating body 9 comprising contact cavities 10 for the positioning and retention of contacts, which shall be inserted during the wiring of the module. On the back face of the insulating body 9 is arranged a back or rear plate 11 provided with a contact-retaining clip 52 and whose sidewalls comprise projecting members 51. A molded thermoplastic receptacle shell 12 comprises a flange 13 obtained during the process of molding of the receptacle shell and is provided with oblong apertures 14, into which the projecting members 51 of the back plate 11 are locked.

On the other hand, the housing 5 of the complementary connector 3 which comprises a space 7' whose section is suited to the reception of a sub-assembly or a movable module 8' consisting of a high contact density sub-miniature connector comprising the same components as those of the sub-assembly 8 and which is identical, with only two exceptions. The first of these exceptions concerns the insulating body 9', whose front coupling face is located on the level of the plane defined by the upper face of the receptacle shell 12'. The second concerns the flange 15, which is likewise obtained during the process of molding of the receptacle shell, opposite the face comprising the flange 15. This flange 15 serves as a cavity to receive the insulating body 9 during the process of connection of the sub-assemblies 8 and 8' and hence the coupling of the connectors 2 and 3.

The groove 7 and the space 7' constitute the preferred (because easily accessible) positioning sites of the sub-assemblies 8 and 8', after they have been wired or re-wired as will be described below.

Figure 3:
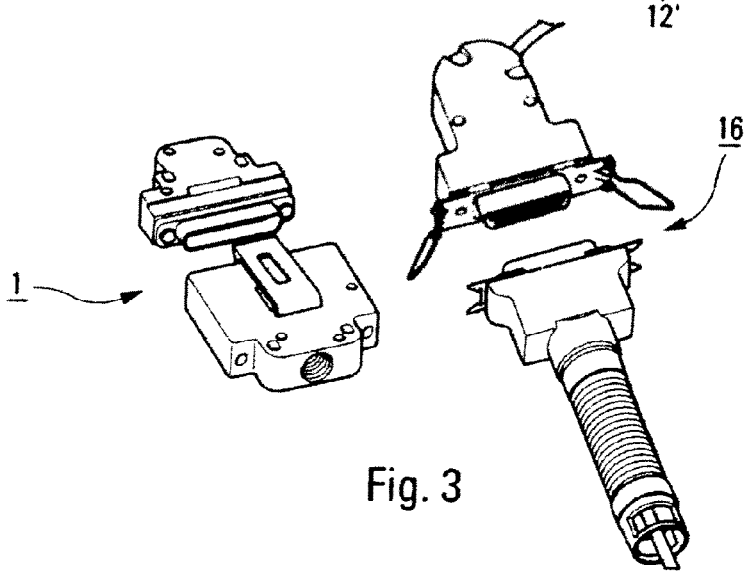
FIG. 3 is a perspective view of an assembly according to the disclosed embodiments and according to the prior art.

FIG. 3 shows on the left a connection assembly 1 of the type of that of the present invention in uncoupled position. On the right of FIG. 3 is shown a connection assembly currently used and usually called Sub-D miniature 16, whose object is that of offering the transmission characteristics of electrical signals close to those furnished by the connection assemblies of the present invention.

The use of movable connection sub-assemblies 8, 8' integrated into the molded thermoplastic nickel-coated half-shells, has led to the surprising result of being able effectively to miniaturize the components of the connection assembly and to gain advantages in terms of both weight and space. In this way, for a Sub-D connection assembly equipped with 25 contacts weighing approximately 60 grams, the invention makes it possible to obtain a weight reduction of approximately 45%, that is to say, to achieve effective results with a total component weight of approximately 33 grams. The position is similar as regards space, since the total length of the coupled assembly 16 is approximately 72.5 mm and the length of assembly 1 of the present invention is approximately 62 mm, a 32% advantage.

It is clear that the invention makes it possible to achieve big advantages in terms of space and weight of any equipment used in audiovisual applications, for example those offered to communal transport passengers and more particularly to passengers of large civil aircraft.

FIG. 4*a* shows an exploded view of components constituting housing 4 of connector 2, which comprises a molded thermoplastic, nickel-clad upper half-shell 4', provided on its upper face with a recess 17 for the positioning of the movable latch 6. A slot 18 extends from one of the edges of the half-shell 4' up to the recess 17, to make possible the positioning of the movable latch 6, being a recess in which the latch will be retained as shall be explained below.

The said half-shell 4' is provided on its inside face with components identical to those shown on the lower half-shell 4", likewise molded from nickel-coated thermoplastic, namely, a groove 7 making possible the positioning of the receptacle shell 12 of the sub-assembly 8, a space 19 making possible the positioning of the cable strand during the process of finishing of the connector 2, steps 20 making possible the guidance of the housing 5 during the process of coupling of connectors 2-3, of the catches 21 for the positioning and fixing of the two half-shells 4', 4" using screws 22, as shown in FIG. 4*b*. As will be seen below, the half-shells are assembled when the sub-assembly 8 has been wired and introduced into the groove 7.

FIG. 5*a* shows an exploded view of components constituting the housing 5 of the connector 3, which comprises a molded thermoplastic nickel-coated upper half-shell 5' provided on its upper face with a slot 23 comprising a projecting edge and acting jointly with the movable latch 6 to lock the connectors 2 and 3.

The said half-shell 5' is provided on its inside face with components identical to those shown on the lower half-shell 5", being likewise of molded thermoplastic and nickel clad, namely, a space 7' making possible the positioning of the receptacle shell 12' of sub-assembly 8', a space 24 making possible the positioning of the strand of cables during the finishing of connector 3, of catches 21 for the relative positioning and fixing of the two half-shells 5', 5" using the screws 22, as shown in FIG. 5*b*. The half-shells 5', 5" comprise at one of their ends, a sidewall 25 comprising on its front face a threaded bore 26, making possible the fixing of the sub-assembly 8' using the screw 27 passing through the apertures 28 made in the receptacle shell 12'. These two identical half-shells thus define the positioning space 7' of the sub-assembly 8' as shown in FIG. 5*b*. As will be seen below, the half-shells are assembled when the sub-assembly 8' has been wired and introduced into the space 7'.

The joint use of molded thermoplastic half-shells shielded by being passed through a surface treatment installation comprising nickel baths, the possibility of assembly and disassembly by screws associated with movable sub-assemblies wired prior to their insertion in the groove and space 7 and 7', makes it possible to obtain a final product, namely, the shielded sub-miniature connection assembly, possessing a very high electrical performance, reduced dimensions, the possibility of replacing modules and easy maintenance.

FIG. 6 shows a connector 2 during the phase preceding the final assembly of a cable connector. A strand 29 of electric wires, whose ends are equipped with crimped contacts 53, has been wired onto the sub-assembly 8. As can be seen from FIG. 6, the sub-assembly 8 constitutes a miniature connector whose front face is formed by the molded thermoplastic insulating body 9, which comprises contact cavities for the positioning and retention of crimped contacts 53 inserted into the said body. The back face of the insulating body 9 is equipped with a back plate, provided with a contact-retaining clip 52 shown in FIG. 2 and enabling the passage through their center of wire insulators constituting the strand 29. The sidewalls of the plate comprise projecting members 51, which lock into the oblong apertures 14 of the flange of the receptacle shell 12. The receptacle shell 12 is then inserted into the groove 7 of the half-shell 4', the strand 29 is positioned in the space 19 whose front open end is equipped with guidance steps 20 for coupling of connectors 2, 3 and whose open back end constitutes a passage for wire 30 receiving the shielded ferrule 31 of strand 29, in such a way as to ensure the continuity of ground of the strand shield and of the half-shells 4', 4".

FIG. 7 shows a connector 3 during the phase of final assembly of a cable connector. The strand 29 of the electric wires, whose ends are equipped with crimped contacts 53, has been wired to the sub-assembly 8'. As can be seen from FIG. 7, the sub-assembly 8' constitutes a subminiature connector, whose front face is formed by the molded thermoplastic insulating body 9', which comprises contact cavities for the positioning and retention of crimped contacts 53 inserted into that body. The back face of the insulating body 9' is equipped with a back plate equipped with a contact-retaining clip 52 making possible the passage through their center of wire insulators constituting the strand 29. The sidewalls of the plate comprise the projecting members 51, which lock into the oblong apertures 14 of the flange 13' of the receptacle shell 12'. The receptacle shell 12' is then inserted into the space 7', defined by the half-shells 5, 5' and by the walls 25, the strand 29 is positioned in the space 24 whose open end constitutes a wire passage 30 able to receive a ferrule 31 shielded strand 29, which ensures the continuity of ground of the strand shield and of the half-shells 5', 5". The half-shell 5" is positioned and fixed to the half-shell 5' using the screws 22 and the catches 21.

FIGS. 8*a* and 8*b* show in detail the locking of connectors 2 and 3 assembled using a metal clip forming the movable latch 6 and its mode of fixing in the recess 17 of the upper face of the half-shell 4' as well as its mode of capture in the slot 23 of the upper face of the half-shell 5' when the connectors 2 and 3 are coupled up. It should be noted that in this form of embodiment, a single means of locking is shown on the upper outside face of the half-shells, but it is clear that the lower outside faces are equipped with this type of latch which functions identically on both the upper and lower faces.

The latch 6 in FIG. 8*b* is a clip machined in an elastic metal plate cut and shaped metal plate in such a way as to ensure the retention of the latch and its capture in the complementary connector. A central cut 32 defines two elastic branches 33 and the free part of the metal plate resulting from the cut is folded through 180° to form an elastic shackle 34 embedded after being inserted via the groove 18 in a compartment 35 of the recess 17. An elastic terminal shackle 36 is provided at the end resting in the recess 17, so as to improve the mechanical retention of the latch and the recovery of background effects when an operator presses the branches 33 in order to separate the connectors 2 and 3. The other end of the clip, that is to say that in contact with the complementary connector, is folded on itself and the resulting fold 37 is positioned at an angle appreciably less than 90° with respect to the plane defined by the horizontal surface of the clip, in order to retain the connectors 2 and 3 firmly, thanks to the action of the fold 37 engaged in the slot 23.

This arrangement makes it possible to use a movable latch, which is removed during the process of the nickel coating treatment of the surfaces of the molded thermoplastic half-shells, making it possible not to expose the latch to the treatment baths. The use of a metal latch thus makes it possible to increase the number of coupling/uncoupling maneuvers of the connectors, compared with plastic latches molded simultaneously with the half-shells.

FIG. 8*a* shows the passages 38 made in the back parts of the half-shells 4', 4", 5' and 5", which make possible the passage of the fasteners and the fixing of the housings 4 and 5 of the connectors 2 and 3 into all configurations.

FIG. 9 shows an example of the embodiment of the wiring of a movable module or of sub-assembly 8, 8' using cables of the twisted quad structure type, that is to say, cables making possible the use of very high frequencies, in particular in on-board networks of the type used in avionics.

According to this example of embodiment, the four wires of three cables are inserted in 12 of the 25 contact cavities 10 of the insulating body 9, 9'. In this arrangement, 4 contiguous contact cavities are grouped and referenced C1, C2 and C3 and are separated by the contact cavities T1, T2 or L1, L2, L3, which represent the locations for the ground and the free line contacts.

As shown in FIGS. 10 to 10*c*, the process of wiring of a movable module 8 or 8' takes place, for example, in the following phases:

- a first cable Q1 comprising a spacing cross-pin 40, making it possible to eliminate distortions between wires, is arranged between the four wires which compose the cable. The cable is stripped along a length vl, making it possible for each of the wires thus freed to be lodged in the space of the half-shell and stripped along a length of flexible braid 39 of the cable shield;
- each wire is stripped and a contact made from an electricity-conducting material is crimped onto the end of the wire;
- each contact equipped with its wire is inserted into the bore made in a clip of the back plate 11 and positioned in a cavity 10 of the insulating body 9 contiguous to three other contact-receiving cavities of the same cable, for example in C1;
- a second cable Q2 is prepared in the same way and the contacts are positioned in C2;
- a third cable Q3 is prepared in the same way and the contacts are positioned in C3;
- Ground contacts are crimped on the flexible braid 39 and positioned in T1 and T2 whilst the wires transmitting the weak signals are equipped with contacts crimped and positioned in free line locations L1, L2 and L3;
- the stripped parts of flexible braids 39 of cables Q1, Q2 and Q3 are grouped and form an assembly of the same potential, thanks to a metal sheet 41 which connects the three flexible braids 39 of cables Q1, Q2 and Q3;
- the earth and the free line wires are arranged round the said sheet 41 and the resulting assembly is covered by a metal sheet connecting the wires and the sheet 41.

The last stage creates a ferrule 31, which makes it possible to provide ground continuity between strand 29 and the shielded housings 4 and 5 of the subminiature connectors 2 and 3, that is to say, provide the continuous shield of a subminiature connection assembly composing the connection of the cable connectors.

With the movable modules 8, 8' wired in this way it is easy to assemble the connectors 2 and 3 using the method previously described and in particular in the description of FIGS. 6 and 7 above.

The embodiments described are not limitative and the variants and modifications made do not breach either the context, or the spirit of the claimed subject matter.

The invention claimed is:

1. A shielded subminiature connection assembly comprising two subminiature connectors with housings comprised of two molded thermoplastic half-shells and shielded by surface treatment, the housings being provided with means of locking the two connectors together, wherein subminiature connector comprises a high contact density miniature sub-assembly with a molded thermoplastic insulating body provided with contact cavities for positioning and retaining contacts, a back plate provided with a contact-retaining clip, the sidewalls of the back plate comprise projecting members, a molded thermoplastic receptacle shell comprising a flange provided with oblong apertures into which the projecting members of the back plate are locked.

2. A shielded subminiature connection assembly according to claim 1 wherein the sub-assembly is movable.

3. A shielded subminiature connection assembly according to claim 1 wherein the molded thermoplastic of the two molded thermoplastic half-shells is coated with a nickel protection.

4. A shielded subminiature connection assembly according to claim 2, wherein the housing comprises a positioning site whose section is suited to receiving a sub-assembly.

5. A shielded subminiature connection assembly according to claim 1 wherein the contact-retaining clip is configured to allow a passage, through a center of the contact-retaining clip, of a strand of insulated electrical wires equipped with crimped contacts.

6. A shielded subminiature connection assembly according to claim 5, wherein the strand comprises a shield ferrule.

7. A shielded subminiature connection assembly according to claim 1 wherein the receptacle shell inserts itself into the site of the half-shell, a of electric wires positions itself in the space whose open back end constitutes a wire passage receiving a shield ferrule of the strand so as to ensure the continuity of ground of a strand shield and of the half-shells.

8. A process of forming a shielded subminiature connection assembly comprising two connectors with housings comprising two molded thermoplastic half-shells and covered with a shield produced by surface treatment, the housings being provided with means of locking the two housings in which each subminiature connector comprises a high contact density miniature sub-assembly consisting of a molded thermoplastic insulating body provided with contact cavities for positioning and retaining the contacts, a back plate provided with a contact-retaining clip, the sidewalls of the back plate comprise projecting members, a molded thermoplastic receptacle shell comprising a flange provided with oblong apertures into which projecting members of the back plate are locked, wherein process comprises:

- the surface treatment of the half-shells of the housing by passage through a nickel bath;
- wiring a movable sub-assembly;
- introducing the wired movable sub-assembly into a positioning site;
- closing the housing by affixing the half-shells together using screws and catches.

9. A process of forming a shielded subminiature connection assembly according to claim 8, wherein wiring the movable sub-assembly further comprises:

- a first cable (Q1) comprising a spacing cross-pin stripped on a length (vl) baring a length of flexible braid of cable shield;
- stripping each wire of the cable stripped and crimping an electricity-conducting material contact onto an end of each wire;
- inserting each contact crimped onto a corresponding wire into a bore made in a clip of the back plate of the sub-assembly and positioned in a cavity of the insulating body contiguous with a first set of contact-receiving cavities of the first cable (C1);
- a second cable (Q2) is prepared in the same way and contacts of the second cable are positioned in a second set of contact-receiving cavities (C2);

a third cable (Q3) is prepared in the same way and contacts of the third cable are positioned in a third set of contact-receiving cavities (C3);

ground contacts are crimped onto each strand of the first, second and third cable, the ground contacts being positioned in contact cavities (T1, T2) while wires transmitting weak signals are equipped with crimped contacts and positioned in free line contact cavity locations (L1, L2, L3);

each stripped portion of each strand of the first, second and third cables (Q1, Q2, Q3) is grouped together and connected to a first metal sheet;

the ground contacts and free line wires are arranged around the first metal sheet and each strand is covered by a second metal sheet forming a shield ferrule.

10. A process of forming a shielded subminiature connection assembly according to claim 8 wherein the shield ferrule is connected to a ground potential and provides ground continuity between each strand and the shielded housings of the sub-miniature connectors and also provides a continuous shield of a subminiature connection assembly forming the link of the cable connectors.

* * * * *

UNITED STATES PATENT AND TRADEMARK OFFICE

CERTIFICATE OF CORRECTION

PATENT NO. : 7,670,180 B2
APPLICATION NO. : 12/138535
DATED : March 2, 2010
INVENTOR(S) : Philippe Gerard et al.

It is certified that error appears in the above-identified patent and that said Letters Patent is hereby corrected as shown below:

In Claim 7, line 24 replace "a of electric wires" with --a strand of electric wires-- therefor.

Signed and Sealed this

Twenty-fourth Day of August, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,670,180 B2
APPLICATION NO. : 12/138535
DATED : March 2, 2010
INVENTOR(S) : Philippe Gerard et al.

It is certified that error appears in the above-identified patent and that said Letters Patent is hereby corrected as shown below:

In Claim 7, Column 8, line 24 replace "a of electric wires" with --a strand of electric wires-- therefor.

This certificate supersedes the Certificate of Correction issued August 24, 2010.

Signed and Sealed this

Twenty-eighth Day of September, 2010

David J. Kappos

David J. Kappos
*Director of the United States Patent and Trademark Office*